United States Patent [19]

Shiratori

[11] Patent Number: 5,069,443

[45] **Date of Patent: * Dec. 3, 1991**

[54] WATER SLIDER LANE

[75] Inventor: Koji Shiratori, Shizuoka, Japan

[73] Assignee: Shiratori Co., Ltd., Japan

[ * ] Notice: The portion of the term of this patent subsequent to Jan. 15, 2008 has been disclaimed.

[21] Appl. No.: 567,765

[22] Filed: Aug. 15, 1990

[30] Foreign Application Priority Data

May 17, 1990 [JP] Japan ..... 2-127103

[51] Int. Cl.[5] ..... A63G 3/00

[52] U.S. Cl. ..... 272/56.5 R; 104/70

[58] Field of Search ..... 272/1 B, 56.5 R; 104/69, 70

[56] References Cited

U.S. PATENT DOCUMENTS 3,830,161 8/1974 Bacon ..... 104/70
4,149,710 4/1979 Rouchard ..... 272/56.5 R
4,836,521 6/1989 Barber ..... 272/56.5 R X
4,984,783 1/1991 Fujimaki ..... 272/56.5 R

*Primary Examiner*—Richard E. Chilcot, Jr.

[57] ABSTRACT

A water slider lane includes a sliding surface the effective portion of which has a width larger than the diameter of a sliding boat. The sliding surface is bent or tilted down toward one side, thereby moving a sliding boat toward a turning zone. A region of the sliding surface, at which the sliding boat approaches the turning zone, is tilted up to form an upward slope, and the upward slope is connected at its upper edge and through a bend to a side wall of the lane, whereby the sliding boat goes up the upward slope to such a degree that its upper portion goes slightly beyond the upper edge of the upward slope. When the sliding surface has its effective portion's width smaller than the diameter of a sliding boat, a step in the form of a ridge and others may be provided on the sliding surface.

8 Claims, 3 Drawing Sheets

WATER SLIDER LANE

BACKGROUND OF THE INVENTION

1. Field of the Invention

The present invention relates to a water slider lane on which a sliding boat of a true or substantial circle slides down and, more particularly, to a water slider lane on which the sliding boat is forced to turn in the course of sliding by making use of its softness.

2. Statement of the Prior Art

A water slider is a sort of slider comprising a lane in the form of a spout along which a stream of water runs down and a sliding boat which slides down with the stream.

This water slider is designed such that the frictional resistance between the sliding boat and the surface of the lane becomes very limited and the sliding speed of the boat is regulated by the flow rate of water. Therefore, the amount of frictional heat generated on the surface of the lane is very limited and the frictional heat, if generated, is absorbed in the stream of water.

In view of the foregoing, the water slider includes an extended lane which is tilted, twisted and bent somewhere to give suitable speed and thrills.

The above conventional water slider includes a semicylindrical lane with the sliding surface being so always in contact with the bottom of the sliding boat that the sliding boat can slide down smoothly. The monotony in sliding, however, spoils fun considerably.

As a way of overcoming the monotony of such a water slider as mentioned above, the present inventor has already invented a water slider including a lane with the sliding surface being tilted toward one side wall, whereby a sliding boat is forced to move with water toward the side wall and come into contact therewith, as described in Japanese Patent Application No. 2(1990)-33452.

In the described water slider, the sliding boat is forced to come into contact with the side wall to produce frictional force, which then gives rotational force to the sliding boat. Much more interest is attached to this water slider than to a conventional one, since more variety and thrills are added to sliding.

With this water slider, however, it is required that the sliding boat be caused to collide with the side wall with some force, thereby giving sufficient rotational force to the sliding boat.

This poses a safety problem, since a boater receives impact when the sliding boat comes into contact with the side wall.

An object of the present invention is to provide a solution to the problem of such a conventional water slider as mentioned above by ensuring that a sliding boat can be turned without applying any substantial impact on it.

SUMMARY OF THE INVENTION

According to one aspect of the present invention, a water slider lane including a sliding surface the effective portion of which has a width larger than the diameter of a sliding boat, wherein:

said sliding surface is inclined toward one side, thereby moving a sliding boat toward a turning zone, a region of said sliding surface, at which said sliding boat approaches said turning zone, is tilted up to form an upward slope, and said upward slope is connected at its upper edge and through a bend to a side wall of said lane, whereby said sliding boat goes up said upward slope to such a degree that its upper portion goes slightly beyond the upper edge of said upward slope.

According to another aspect of the present invention, there is provided a water slider including a sliding surface the effective portion of which has a width smaller than the diameter of a sliding boat, wherein:

said sliding surface is provided with a step of a predetermined length in the longitudinal direction thereof to form a turning zone, whereby said boat is caused to turn around said turning zone, while the former is in contact with the latter.

The step may be in a ridge form; in an inclined, convex form which rises from one side of said sliding surface toward the side wall; or depressed in a flat form in its bottom and inclined from said effective portion of said sliding surface toward the side wall.

As the sliding boat slides down the thus constructed lane in the first aspect of the present invention, a force p directing toward the side wall and a force q directing downward along the side wall occur at the turning zone, as shown in FIG. 2. The former force p permits the sliding boat to go up the upward slope to such a degree that its upper portion goes slightly beyond the upper edge of the upward slope.

Owing to flexibility of the material of which it is constructed, the sliding boat is deformed along its bottom in accordance with the curved shape of the sliding surface and upward slope, so that no or little frictional force occurs between the bottom of the boat and the sliding surface/upward slope, because of presence of water therebetween. At the upper edge of the upward slope, however, a pressure (FIG. 1) acts on the bottom of the sliding boat, so that the boat becomes deformed there, impeding the sliding of the boat.

Therefore, apparent braking force acts on the upper portion of the sliding boat with the remaining portion being subject to the downward force q, so that the boat can turn in the counterclockwise direction as shown in FIG. 2.

As the sliding boat slides down the sliding lane according to the second aspect of the present invention, it inevitably reaches above or beneath the step as shown in FIG. 6. At this time, the boat turns upon receiving a resisting force R from the step.

BRIEF DESCRIPTION OF THE DRAWINGS

The present invention will now be explained in greater detail, by way of example alone, with reference to the accompanying drawings, in which:

FIG. 2 is a plan view illustrating one embodiment of the lane on which the sliding boat is forced to move toward the turning zone S and FIGS. 3 to 6 are views similar to FIG. 1, showing other embodiments, in which FIGS. 3 to 5 are cross-sectional views, similar to FIG. 1 and FIG. 6 is a plan view, similar to FIG. 2.

DETAILED EXPLANATION OF THE EMBODIMENTS

Figure 1:
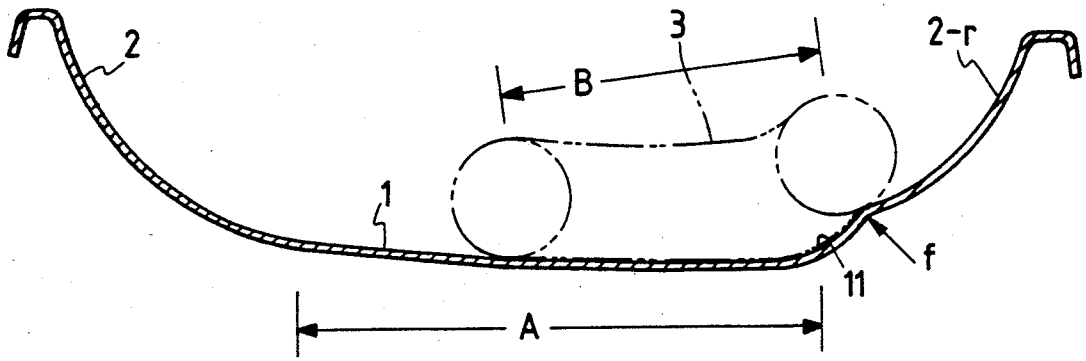
FIG. 1 is a cross-sectional view illustrating one embodiment of a turning zone of the lane of the water slider according to the present invention, on which a sliding boat is to turn.
Figure 2:
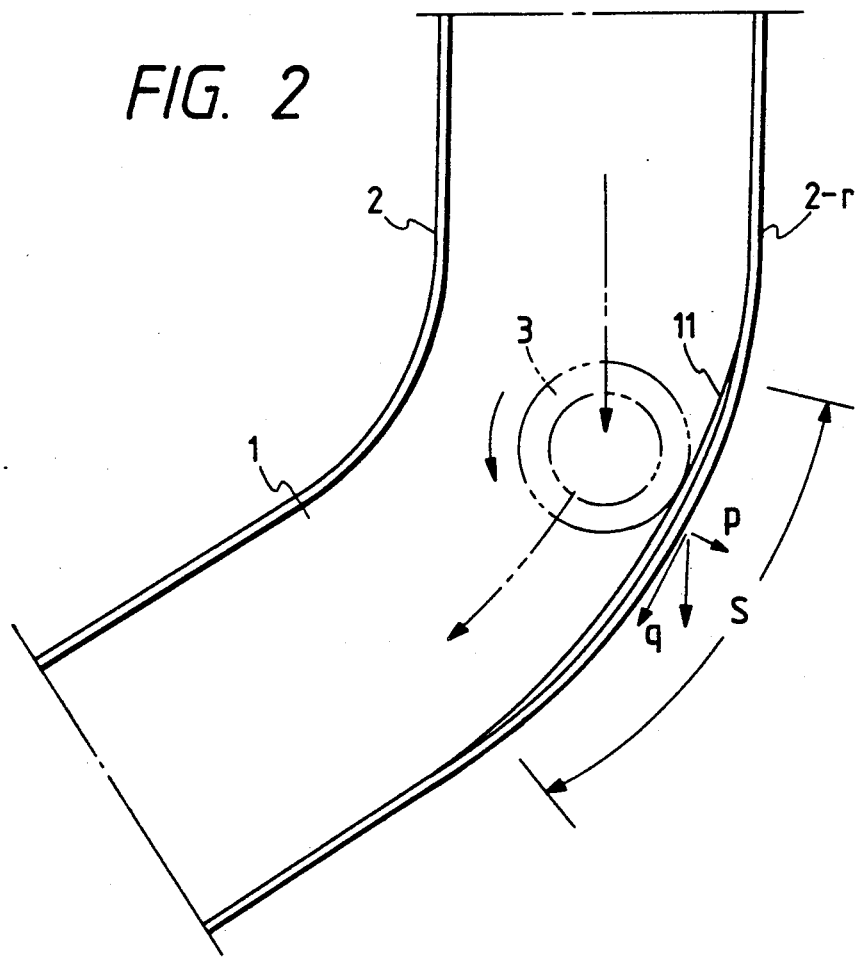

Referring now to FIGS. 1 and 2, there is shown an embodiment of a slider lane 1 used with a sliding boat 3 having a diameter B smaller than the width A of an effective portion of its sliding surface 1.

That portion forms a part of the slider lane, including a sliding surface 1 and side walls 2 integrally formed on its both sides, said surface 1 being defined by a curved surface of large curvature. Although not illustrated, the sliding lane is of a finite continuous length, with a suitable amount of water being caused to flow down on it. The sliding boat 3 is forced to move with a stream of water toward a turning zone S, on which it is to turn.

At the zone S, the sliding lane 1 is tilted upwardly to form an upward slope 11 which the sliding boat is to go up. In particular, the upper edge of the upward slope 11 is joined through a bend to a side wall 2-r, and the sliding boat is to go slightly beyond the upper edge thereof.

The sliding boat 3, similar to an ordinary sliding boat, is a sort of rubber boat and possesses sufficient flexibility to be deformed along the curved shape of the slider lane 1.

The rest, not shown, of the sliding lane is similar to that of a conventional water slider lane. That is, both side walls and the sliding surface define together a concave surface in the form of a substantially semi-cylindrical spout as a whole. A sliding course, which the sliding boat is to slide down, is located at about the center of the sliding surface, and is designed such that even when the sliding course is off-center where the sliding lane is turned or bent, the sliding boat always at its bottom alone comes into contact with the sliding surface.

Making use of the sliding boat 3 having the property of sliding down linearly by the force of inertia, a sliding lane shown in FIG. 2 is designed such that the sliding boat 3, sliding down from above, inevitably goes straight on toward the turning zone S. The sliding lane is bent through a bend with the outer zone defining the turning zone S.

In another embodiment in which the sliding boat 3 is forced to move toward the turning zone S, the sliding surface 1 of the sliding lane is tilted downwardly toward the turning zone S, as illustrated in FIG. 1.

That is, as illustrated, the sliding surface 1 is tilted down slightly toward the side wall 2-r and is located at the lowermost position adjacent to the side wall 2-r. Flowing down from above, water first flows toward the side wall 2-r through this region, reaches the side wall 2-r and flows down along this region. By the stream of water, the sliding course, which the sliding boat 3 is to slide down, directs toward the side wall 2-r, so that the boat 3 can move toward the side wall 2-r, reaches at its side edge the side wall 2-r, and goes up the upward slope 11.

Figure 3:
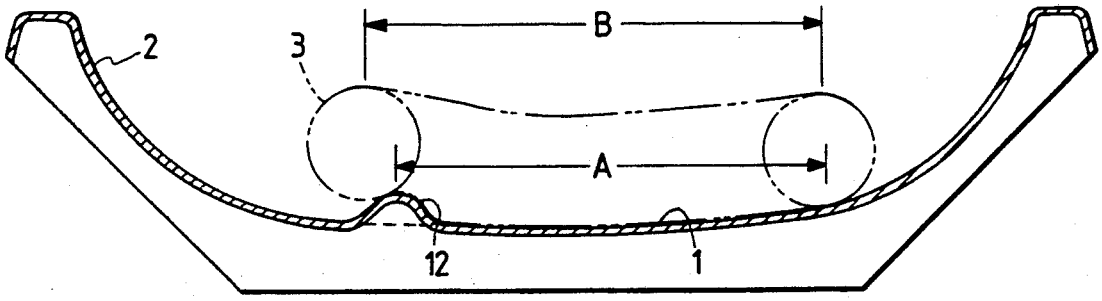
Figure 4:
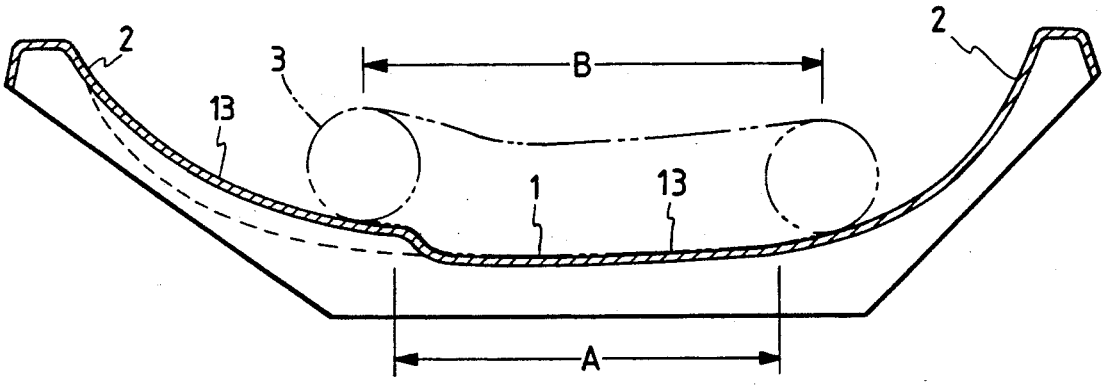
Figure 5:
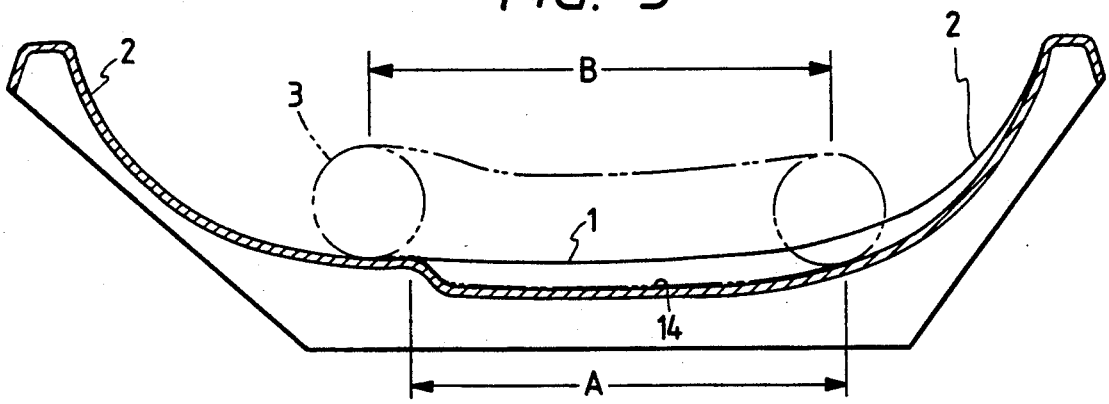
Figure 6:
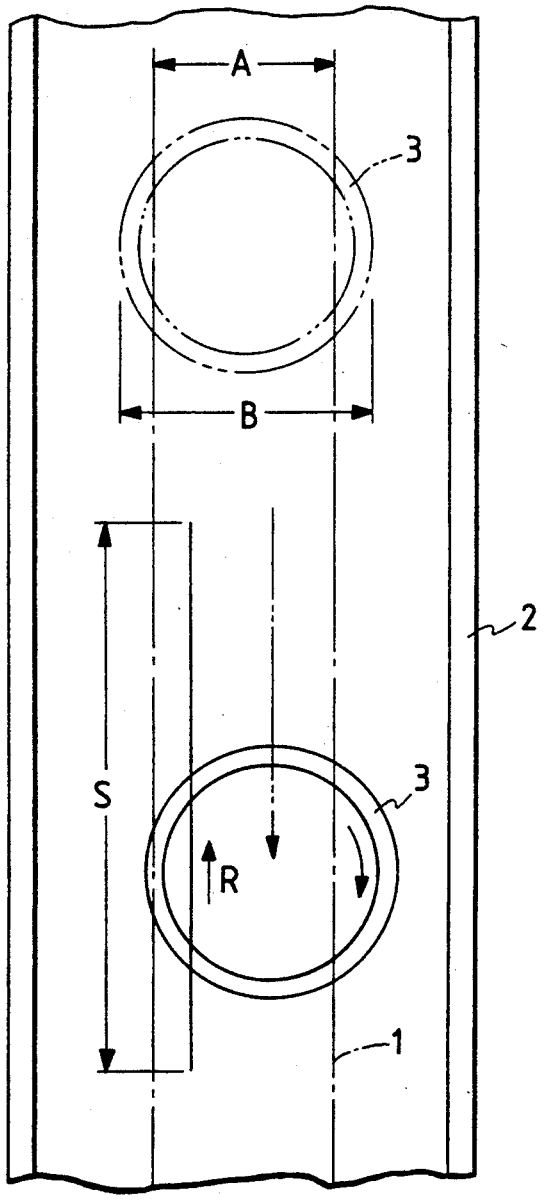

Referring to FIGS. 3 to 6, there are shown another embodiments of the present invention, in which a sliding boat 3 has a diameter B larger than the width A of an effective portion of a sliding surface 1. FIGS. 3 to 5 are cross-sectional views, similar to FIG. 1, of turning zones of a sliding lane of the water slider, and FIG. 6 is a plan view, similar to FIG. 2, showing a part of a sliding lane.

Referring to FIGS. 3 to 5, these are three embodiments each designed such that a step of a predetermined length is formed on a sliding surface in the longitudinal direction of a sliding lane to define a turning zone S, thereby turning the boat 3 around the turning zone S while the former is in contact with the latter.

In the embodiment illustrated in FIG. 3, a step 12 is defined by a ridge.

In the embodiment illustrated in FIG. 4, a step 13 is in an inclined, convex form which rises from one side (the left-hand side in the drawing) of a sliding surface 1 toward a side wall 2.

In the embodiment illustrated in FIG. 5, a step 14 is depressed in a flat form in its bottom and inclined from an effective portion of a sliding surface 1 toward a side wall 2.

These embodiments work substantially in the same manner as explained in connection with FIG. 2.

In each of the sliding lanes in which the diameter B of the sliding boat 3 is larger than the width A of the effective portion of the sliding surface 1, as the boat reaches the step 12, 13 or 14, its end edge is inevitably located above or beneath the step. At this time, the boat 3 turns by receiving a resisting force R from the step 12, 13 or 14.

As detailed above, when the width of the effective portion of the sliding surface is larger than the diameter of the sliding boat, on the one hand, the water slider lane according to the present invention is designed such that a sliding boat, sliding down from above, moves toward its one side, and this region of the sliding surface is tilted upwardly to form an upward slope, which the sliding boat slides up to such a degree that its upper portion goes beyond the upper edge of the upward slope. When the diameter of the boat is smaller than the width of the effective portion, it is designed such that the step is formed on the sliding surface to apply resisting force to the boat, thereby turning it naturally.

Therefore, it is possible to turn the sliding boat without applying any substantial impact on it.

I claim:

1. A water slider used with a tobogganing boat having a deformable bottom portion, said water slider comprising opposing side walls and a connecting slide surface and adapted to permit said boat to travel along said water slider;

a portion of said connecting slide surface being inclined downwardly in a lateral direction from one opposing side wall to the other, whereby said boat is caused to be directed laterally toward said other side wall while travelling along said slide surface;

a portion of said slide surface toward which said boat is directed laterally including an upwardly inclined raised portion, said raised portion being configured to permit a portion of the bottom of said boat to extend over and deformably engage said raised portion while being directed toward said other side wall, whereby said boat is caused to rotate circumferentially due to said engagement between said portion of said bottom portion of said boat and said raised portion as said boat travels along said water slider.

2. The water slider of claim 1 wherein the width of said slide surface is greater than the greatest diameter of said boat.

3. The water slider of claim 1 wherein said upwardly inclined raised portion is positioned along the outer lateral extent of a portion of said water slider which is curved along the longitudinal axis of said water slider and adapted to change the direction of movement of said tobogganing boat as said boat travels along said water slider.

4. A water slider used with a tobogganing boat having a deformable bottom portion;

said water slider comprising opposing side walls and a connecting slide surface, a portion of the lateral extent on one side of said connecting slide surface being defined by an outwardly inclined raised portion of finite length which finite length is less than the length of said water slider, said raised portion configured to permit a portion of the deformable bottom of said boat to extend over and deformably engage said raised portion upon said boat passing along said slide surface, whereby said boat is caused to rotate circumferentially due to said engagement between said portion of said boat and said inclined portion as said boat travels along said water slider.

5. The water slider of claim 4 wherein said inclined raised portion comprises a ridge.

6. The water slider of claim 4 wherein said inclined raised portion is connected to an adjacent side wall by a substantially planar inclined surface.

7. The water slider of claim 4 wherein said inclined raised portion is connected to an adjacent side wall by an inclined substantially convex surface.

8. The water slider of claim 4 wherein the lateral extent of said slide surface adjacent said inclined raised portion is smaller in width than the greatest diameter of said boat, whereby a portion of the bottom of said boat is caused to extend over and engage said inclined surface as said boat travels along said water slider.

* * * * *